United States Patent [19]

Goi

[11] Patent Number: 5,000,322

[45] Date of Patent: Mar. 19, 1991

[54] BILL RECEIVING AND DISPENSING MACHINE

[75] Inventor: Kouichi Goi, Kawasaki, Japan

[73] Assignee: Laurel Bank Machines Co., Ltd., Tokyo, Japan

[21] Appl. No.: 358,165

[22] Filed: May 30, 1989

[30] Foreign Application Priority Data

May 31, 1988 [JP] Japan ..... 63-133213
May 18, 1989 [JP] Japan ..... 1-125068

[51] Int. Cl.[5] ..... B07C 5/38; B65H 31/26

[52] U.S. Cl. ..... 209/534; 235/379; 271/3

[58] Field of Search ..... 194/206, 207; 209/534; 221/198; 271/3, 3.1, 157, 158, 159, 165, 166; 235/379

[56] References Cited

U.S. PATENT DOCUMENTS

| | | | |
|---|---|---|---|
| 4,106,764 | 8/1978 | Tamura | 271/165 X |
| 4,365,700 | 12/1982 | Arimoto et al. | 194/206 |
| 4,465,192 | 8/1984 | Ohba et al. | 271/166 X |
| 4,726,474 | 2/1988 | Arikawa et al. | 194/206 X |
| 4,744,468 | 5/1988 | Goi et al. | 209/534 |
| 4,854,452 | 8/1989 | Uchida et al. | 209/534 |
| 4,890,824 | 1/1990 | Uchida et al. | 209/534 X |
| 4,905,841 | 3/1990 | Hirata et al. | 209/534 |

FOREIGN PATENT DOCUMENTS

| | | |
|---|---|---|
| 60-100283 | 6/1985 | Japan . |
| 2105507 | 3/1983 | United Kingdom . |

*Primary Examiner*—F. J. Bartuska
*Attorney, Agent, or Firm*—Fleit, Jacobson, Cohn, Price, Holman & Stern

[57] ABSTRACT

A bill receiving and dispensing machine capable of receiving bills of two or more denominations and dispensing bills of at least one denomination among the denominations of the received bills. A plurality of stackers for storing the received bills and feed-out rollers for taking out bills stored in the plurality of stackers one by one from the plurality of stackers by frictional force between each of the feed-out rollers and the lower face of the lowermost bill. The feed-out rollers are positioned at a lower portion of the plurality of stackers. One of the plurality of stackers includes a pooling compartment for temporarily storing the received bills. A bill holding plate for receiving bills from the pooling compartment and holding them on the upper face thereof, the bill holding plate being movable in the vertical direction while being held horizontally. A bottom plate for holding bills to be dispensed on the upper face thereof, the bottom plate being disposed at a bottom portion of the one of the plurality of stackers. An elevator for moving and positioning the bill holding plate at an upper position close to the pooling compartment when receiving the received bills from the pooling compartment and moving and positioning the bill holding plate at a lower position to press the bills held on the bottom plate when feeding out the bills held on the bottom plate from one of the plurality of stackers.

10 Claims, 5 Drawing Sheets

BILL RECEIVING AND DISPENSING MACHINE

CROSS REFERENCE OF RELATED APPLICATIONS

The present invention relates generally to the subject matter of the following prior United States patent applications: Ser. No. 07/113,237, filed on Oct. 27, 1987, entitled "Bill Receiving and Dispensing Machine" now U.S. Pat. No. 4,854,452, Ser. No. 07/136,379, filed on Dec. 22, 1987, entitled "Bill Receiving and Dispensing Machine" now U.S. Pat. No. 4,890,824 and Ser. No. 07/223,810, filed on July 25, 1988, entitled "Money Receiving and Disbursing Machine" now U.S. Pat. No. 4,905,841.

BACKGROUND OF THE INVENTION

The present invention relates to a bill receiving and dispensing machine, and more particularly to a circulation-type bill receiving and dispensing machine capable of dispensing received bills of specific denominations.

DESCRIPTION OF THE PRIOR ART

U.S. Pat. No. 4,744,468 which is a U.S. counterpart of unexamined Japanese Patent Publication No. 60(1985)100283 discloses a bill receiving and dispensing machine which stores bills deposited from a bill receiving opening in stackers separately in accordance with their denominations and dispenses bills stored in the stackers via a bill dispensation opening when dispensing bills.

However, some denominations of paper currency, such as 5000 yen bills, are not used so frequently as other paper currency denominations. The bills of such denominations are thus neither deposited into and dispensed from the bill receiving nor dispensing machine so frequently. Nevertheless, since stackers having the same capacity for each denomination of bills are used in the above mentioned bill receiving and dispensing machine, the frequency of use of a stacker for storing bills of a denomination which is not used so frequently is inevitably low. Therefore, in the case where the capacity of all the stackers is determined so as to be suitable for the frequency of use of bills having other denominations, some of the space within the machine remains unused. As a result, the size of the bill receiving and dispensing machine inevitably is larger than necessary. On the other hand, if the capacity of the stackers is determined so as to be suitable for the frequency of use of bills of the denominations which are not used so frequently, not all of the bills having other denominations can be stored in the stackers. This makes the bill receiving and dispensing machine useless.

SUMMARY OF THE INVENTION

It is, therefore, an object of the present invention to provide a circulation-type bill receiving and dispensing machine which can be made compact.

According to the present invention, the above and other objects can be accomplished by a bill receiving and dispensing machine capable of receiving bills of two or more denominations and dispensing bills of at least one denomination among the denominations of the received bills and comprising a plurality of stacker means for storing the received bills and feed-out roller means for taking out bills stored in said plurality of stacker means one by one from said plurality of stacker means by frictional force between the feed-out roller means and the lower face of the lowermost bill, said feed-out roller means being positioned at a lower portion of said plurality of stacker means, one of said plurality of stacker means comprising pool means for temporarily storing the received bills, bill holding plate means for receiving bills from said pool means and holding them on the upper face thereof, said bill holding plate means being movable in the vertical direction while being held horizontally, and bottom plate means for holding bills to be dispensed on the upper face thereof, said bottom plate means being disposed at a bottom portion of said one of the plurality of stacker means, said bill receiving and dispensing machine further including elevating means for moving and positioning said bill holding plate means at an upper position close to said pool means when receiving the received bills from said pool means and moving and positioning said bill holding plate means at a lower position where said bill holding plate means can press the bills held on said bottom plate means when feeding out the bills held on said bottom plate means from said one of the plurality of stacker means.

The above and other objects and features of the present invention will become apparent from the following description made with reference to accompanying drawings.

DESCRIPTION OF THE PREFERRED EMBODIMENTS

Figure 1:
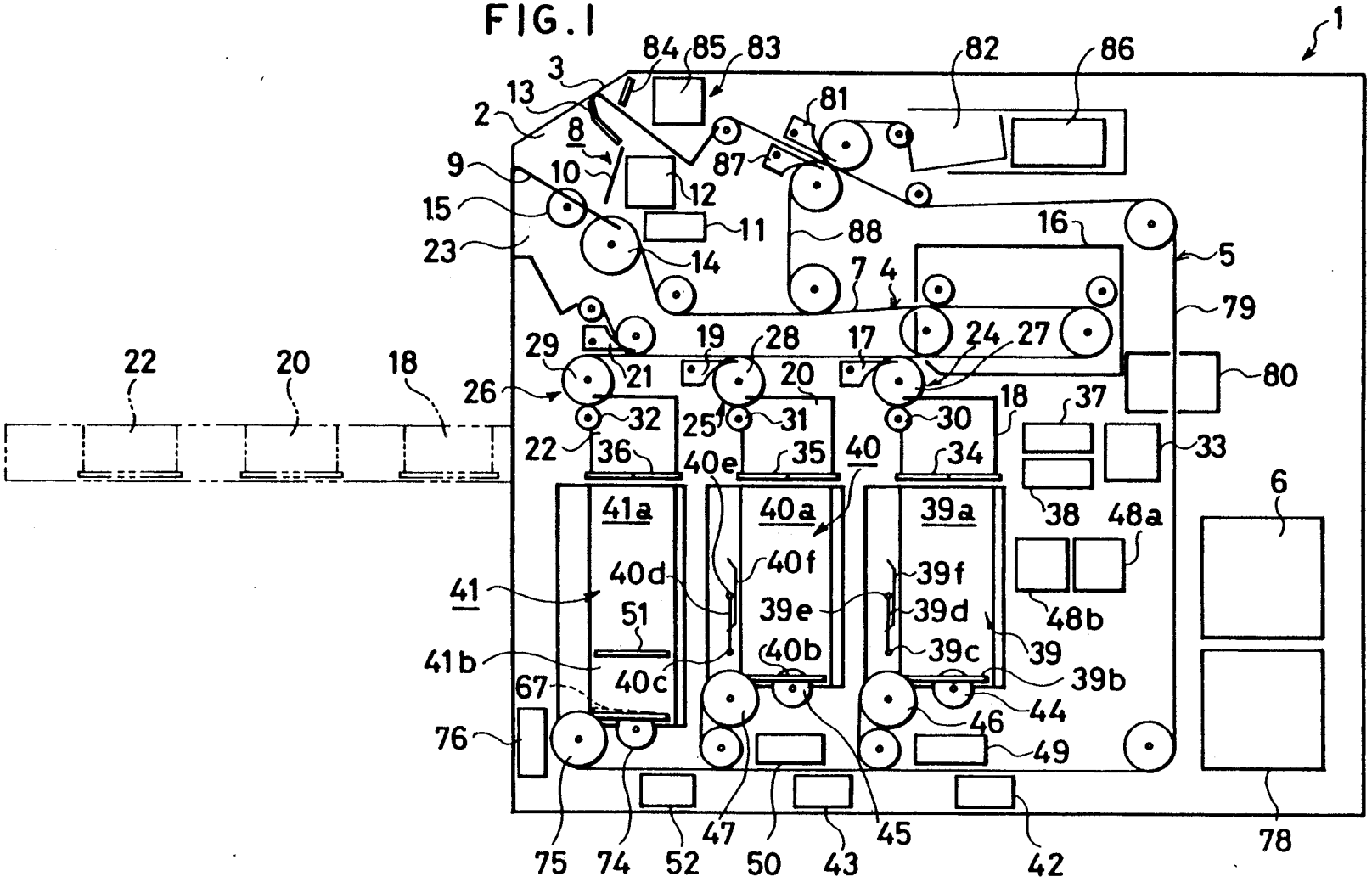
FIG. 1 is a schematic drawing showing the mechanism of a bill receiving and dispensing machine which is an embodiment of the present invention.

FIG. 1 is a schematic drawing showing the mechanism of a bill receiving and dispensing machine which is an embodiment of the present invention and which is constituted so as to be able to receive and dispense three denominations of bills.

Referring to FIG. 1, on one side of the bill receiving and dispensing machine designated generally by reference numeral 1, there are provided a bill depositing opening 2 via which bills are deposited into the bill receiving and dispensing machine 1 by a teller and a bill dispensation opening 3 via which bills are dispensed from the bill receiving and dispensing machine 1 by a teller. In the bill receiving and dispensing machine 1, a bill receiving passage 4 which starts from the bill depositing opening 2 and a dispensation bill passage 5 which terminates at the bill dispensation opening 3 are provided.

Bills received via the bill depositing opening 2 are fed to the inside of the bill receiving and dispensing machine 1 via a bill receiving means 8 along the bill receiving passage 4 by transporting belts 7 driven by a bill receiving motor 6.

The bill receiving means 8 comprises a bill holding plate 9 for accumulating and holding the received bills on the upper face thereof, the bill holding plate 9 being disposed so as to be inclined downwardly toward the inside of the bill receiving and dispensing machine 1, a front plate 10 for forming a bill take-out opening between the bill holding plate 9 and the lower edge thereof, the front plate 10 being disposed above and in the vicinity of the lower edge of the bill holding plate 9, a shutter (not shown) driven by a shutter solenoid 11 so as to open and close the bill take-out opening and able to be in contact with the bills accumulated on the upper face of the bill holding plate 9 and arrange the lower edges of the bills uniformly when the bill take-out opening is closed, a bill press member 13 driven by a bill press motor 12 so as to be able to take positions close to and apart from the bill holding plate 9 and press the received bills accumulated on the upper face of the bill holding plate 9 when it takes the position close to the bill holding plate 9, a take-out roller 14 provided so as to project upwardly- from the upper face of the bill holding plate 9 via a notch (not shown) formed at the lower portion of the bill holding plate 9 and able to take out bills accumulated on the upper face of the bill holding plate 9 one by one to the bill transporting belts 7, and a feed roller 15 provided so as to project upwardly from the upper face of the bill holding plate 9 via an opening (not shown) formed in the bill holding plate 9 and able to be rotated in synchronism with the take-out roller 14, thereby to feed bills accumulated on the bill holding plate 9 one by one to the take-out roller 14. The take-out roller 14 and the feed roller 15 can be driven by the bill receiving motor 6.

In the case where the bills deposited into the bill receiving and dispensing machine 1 via the bill depositing opening 2 and accumulated on the upper face of the bill holding plate 9 are fed to the bill transporting belts 7, the take-out roller 14 and the feed roller 15 are rotated by driving the bill receiving motor 6 under the condition where the shutter closes the bill take-out opening, thereby to arrange the lower edges of the received bills uniformly, and then the bill press member 13 is moved by the bill press motor 12 so as to press the upper face of the accumulated bills. Afterward, the bill take-out opening is opened by the shutter and the take-out roller 14 and the feed roller 15 are rotated again by driving the bill receiving motor 6, whereby bills are fed to the bill transporting belts 7 one by one by frictional force produced between the bills and the take-out roller 14 and the feed roller 15.

A received bill discriminating section 16 is provided in the bill receiving passage 4 and judgment is made on the bills transported by the bill transporting belts 7 along the bill receiving passage 4 in a known manner in the received bill discriminating section 16 as to their denominations, their genuineness, that is, whether they are genuine or counterfeit, their condition, that is, whether or not they are damaged to an extent necessary to be removed, and whether or not the bills are fed one by one. Further, the received bill discriminating section 16 counts the value of the bills.

The received bills are further fed to a first gate 17 which can be switched by a solenoid (not shown) from the received bill discriminating section 16 and the first gate 17 feeds into a first pool section 18 disposed below the first gate 17 the bills which have been discriminated by the received bill discriminating section 16 as being genuine, undamaged, free from double feeding and of a first denomination such as 10000 yen.

On the other hand, the bills other than those which have been discriminated by the received bill discriminating section 16 as being genuine, undamaged and of the first denomination are passed through the first gate 17 and fed to a second gate 19 which can be switched by a solenoid (not shown). The second gate 19 feeds the bills which have been discriminated by the received bill discriminating section 16 as being genuine, undamaged, free from double feeding and of a second denomination such as 1000 yen into a second pool section 20 disposed below the second gate 19.

The bills other than those which have been discriminated by the received bill discriminating section 16 as being genuine, undamaged and of the first or second denomination are further fed by the bill transporting belts 7 to a third gate 21 which can switched by a solenoid (not shown). The third gate 21 feeds the bills which have been discriminated by the received bill discriminating section 16 as being genuine, free from double feeding and of a third denomination such as 5000 yen which are not used so frequently as the first and second denominations and the bills which have been discriminated as being genuine bills having the first or second denomination but damaged to an extent requiring their collection for removal into a third pool section 22 disposed below the third gate 21. Further, as the result of counting the value of the received bill conducted by the received bill discriminating section 16, when it is judged that there is no longer any room to store the bills having the first or second denomination in the first pool section 18 or the second pool section 20, the bills which are to be fed to the first pool section 18 or the second pool section 20 and transported from the received bill discriminating section 16 to the first gate 17 or the second gate 19 afterward pass through the first gate 17 or the second gate 19 and are fed to the third gate 21 to be stored in the third pool section 22.

Further, the bills which have been discriminated by the received bill discriminating section 16 as being counterfeit or as not being fed one by one (double feed) pass through the third gate 21 and are fed to a bill return opening 23 to be returned to the teller.

Feeding the bills to the first pool section 18, the second pool section 20 or the third pool section 22 by the first gate 17, the second gate 19 or the third gate 21 is carried out by a first feed mechanism 24, a second feed mechanism 25 or a third feed mechanism 26 respectively.

The first feed mechanism 24, the second feed mechanism 25 and the third feed mechanism 26 are provided between the first gate 17, the second gate 19 and the third gate 21, and the first pool section 18, the second pool section 20 and the third pool section 22 respectively and each comprises a feed-in roller 27, 28 or 29 driven by the bill receiving motor 6 and a vaned wheel 30, 31 or 32 which has a plurality of vanes and is rotated in synchronism with the feed-in roller 27, 28 or 29. The bills are fed into spaces between adjacent vanes (not shown in FIG. 1) of the vaned wheel 30, 31 or 32 one by one and further fed into the first pool section 18, the second pool section 20 or the third pool section 22 one by one to be stored therein by the rotation of the vaned wheel 30, 31 or 32 in the direction toward the first pool section 18, the second pool section 20 or the third pool section 22.

The bottom portion of the first pool section 18, the second pool section 20 and the third pool section 22 are respectively formed with a first pool gate 34, a second pool gate 35 and a third pool gate 36 which can be opened and closed by a pool gate motor 33. The first pool gate 34, the second pool gate 35 and the third pool gate 36 are normally maintained to be closed by a pool gate lock solenoid 37 and are driven by the pool gate motor 33 in accordance with the teller's instruction to open them.

Although not shown, there is provided a slide mechanism for pulling out the first pool section 18, the second pool section 20 and the third pool section 22 from the bill receiving and dispensing machine 1 and in the case where a customer requests that the deposit of bills be stopped for some reasons after the bills have been stored in the first pool section 18, the second pool section 20 and the third pool section 22, the teller can pull out the first pool section 18, the second pool section 20 and the third pool section 22 as shown by phantom lines in FIG. 1 and collect the bills stored therein or confirm the value of the bills stored therein. These first pool section 18, second pool section 20 and the third pool section 22 can be held at a predetermined position by a pool section lock solenoid 38 which is turned off in accordance with the teller's instruction when they are pulled out.

Below the first pool section 18, the second pool section 20 and the third pool section 22, a first stacker 39, a second stacker 40 and a third stacker 41 are respectively provided across the first pool gate 34, the second pool gate 35 and the third pool gate 36.

In the case of receiving bills, when the value of the deposited bills expected by the teller agrees with the value of the received bills counted by the received bill discriminating section 16 and the teller inputs receiving instructions to the machine 1 after the received bills have been stored in the first pool section 18, the second pool section 20 and the third pool section 22, the pool gate motor 33 is driven, whereby the first pool gate 34, the second pool gate 35 and the third pool gate 36 are opened. Then, the first stacker 39, the second stacker 40 and the third stacker 41 respectively receive the bills temporarily stored in the first pool section 18, the second pool section 20 and the third pool section 22 and store them therein. The bills having the first denomination or the second denomination and received in the first stacker 39 or the second stacker 40 are used for dispensation but the bills received in the third stacker 41 are not used for dispensation and are stored in the third stacker 41. The bills of the third denomination for dispensing are stored in advance in a section of the third stacker 41 separately from the section where the received bills are stored.

The first stacker 39 and the second stacker 40 have the same structure and each comprises a bill storing compartment 39*a*, 40*a* for storing the bills having the first or second denomination, a bill holding plate 39*b*, 40*b* movable in the vertical direction while being held horizontally by an elevator motor 42, 43, which can receive the received bills from the first pool section 18 or the second pool section 20 and accumulate them on the upper face thereof at an upper position close to the first pool gate 34 or the second pool gate 35, a swing member 39*d*, 40*d* swingable clockwise in FIG. 1 about a horizontal shaft 39*c*, 40*c*, and a bill press member 39*f*, 40*f* swingably mounted on a shaft 39*e*, 40*e* at the tip end of the swing member 39*d*, 40*d* and capable of pressing the bills held on the upper face of the bill holding plate 39*b*, 40*b* when dispensing bills. In each of the bill storing compartments 39*a*, 40*a*, a bill take-out opening (not shown) is formed for feeding out bills stored in the compartment 39*a*, 40*a* for dispensation. Each of the bill holding plates 39*b*, 40*b* is normally positioned at a lowermost position except when receiving the bills from the first pool section 18 or the second pool section 20 and has the same shape as that of the bill holding plate 9. More specifically, in the condition where the bill holding plate 39*b* (40*b*) is positioned at the lowermost position, a feed roller 44 (45) for dispensing the bills projects upwardly from the upper face of the bill holding plate 39*b* (40*b*) via an opening (not shown) formed therein and a take-out roller 46 (47) for dispensing the bills projects upwardly from the upper face of the bill holding plate 39*b* (40*b*) via a notch (not shown) formed at the lower portion thereof.

Although not shown, when receiving the bills from the first and second pool sections 18, 20, it is respectively detected by limit sensors whether or not the bill holding plates 39*b*, 40*b* are positioned at the upper position.

As explained above, the bills stored in the bill storing compartments 39*a*, 40*a* of the thus constituted first and second stacker 39, 40 are used for dispensation. When dispensing the bills, the number of the bills stored in the bill storing compartments 39*a*, 40*a* is detected by a control unit (not shown) and in the case where the number of the stored bills is not greater than a predetermined number, the control unit drives the bill press member drive motors 48*a*, 48*b* and swings the swing members 39*d*, 40*d* clockwise in FIG. 1 to enable the bill press members 39*f*, 40*f* swingably mounted on the shafts 39*e*, 40*e* at the tip ends of the swing members 39*d*, 40*d* to press the upper face of the bills accumulated on the upper face of the bill holding plates 39*b*, 40*b*. Thus, frictional force is produced between the lower face of the lowermost bill, and the feed rollers 44, 45 and the take-out rollers 46, 47 and the bills can be taken out one by one from the bill storing compartments 39*a*, 40*a*. On the other hand, in the case where control unit judges that the number of the bills stored in the bill storing compartments 39*a*, 40*a* is greater than the predetermined number, since frictional force having a predetermined magnitude can be produced between the lower face of the lowermost bill, and the feed rollers 44, 45 and the take-out rollers 46, 47 by the dead load of the bills, the bills can be taken out one by one from the bill storing compartments 39*a*, 40*a* without driving the bill press member drive motors 48*a*, 48*b* by the control unit.

Although not shown in FIG. 1, at the bill take-out openings through which the bills are taken out from the bill storing compartments 39*a*, 40*a* of the first and second stackers 39, 40, there are provided shutters for opening and closing the bill take-out opening driven by shutter solenoids 49, 50.

On the other hand, the third pool section 22 stores the bills discriminated by the received bill discriminating section 16 as genuine and having the third denomination, such as 5000 yen, which are not used so frequently as the first or second denomination of bills, the bills having the first or second denomination and discriminated by the received bill discriminating section 16 as genuine but damaged to an extent requiring their collection for removal, and the bills having the first or second denomination which could not be received by the first pool section 18 or the second pool section 20 since it was full. The third stacker 41 receives these bills temporarily stored in the third pool section 22 via the third pool gate 36 but the thus received bills are not used for dispensation since they consist of bills of various denominations and damaged bills.

For this reason, a bill holding plate 51 movable in the vertical direction is provided in the third stacker 41 and the third stacker 41 is divided into a received bill storing compartment 41*a* for storing the above described received bills and a dispensation bill storing compartment 41*b* for storing the bills having the third denomination such as 5000 yen which are not used so frequently. The third denomination bills to be dispensed are stored in advance in the dispensation bill storing compartment 41*b*. Since the bills having the third denomination are not used so frequently as compared with the bills having the first or second denomination, even in the case where the received bills are not used for dispensation and bills stored in advance are exclusively used for dispensation, there is no risk of the bills to be dispensed becoming short in supply. Therefore, space can be saved and the bill receiving and dispensing machine 1 can be made compact by utilizing a part of the third stacker 41 for storing the bills having the third denomination for dispensation as a bill storing compartment for storing the damaged bills having the first or second denomination and the received bills having the first or second denomination which could not be received by the first pool section 18 or the second pool section 20.

Figure 2:
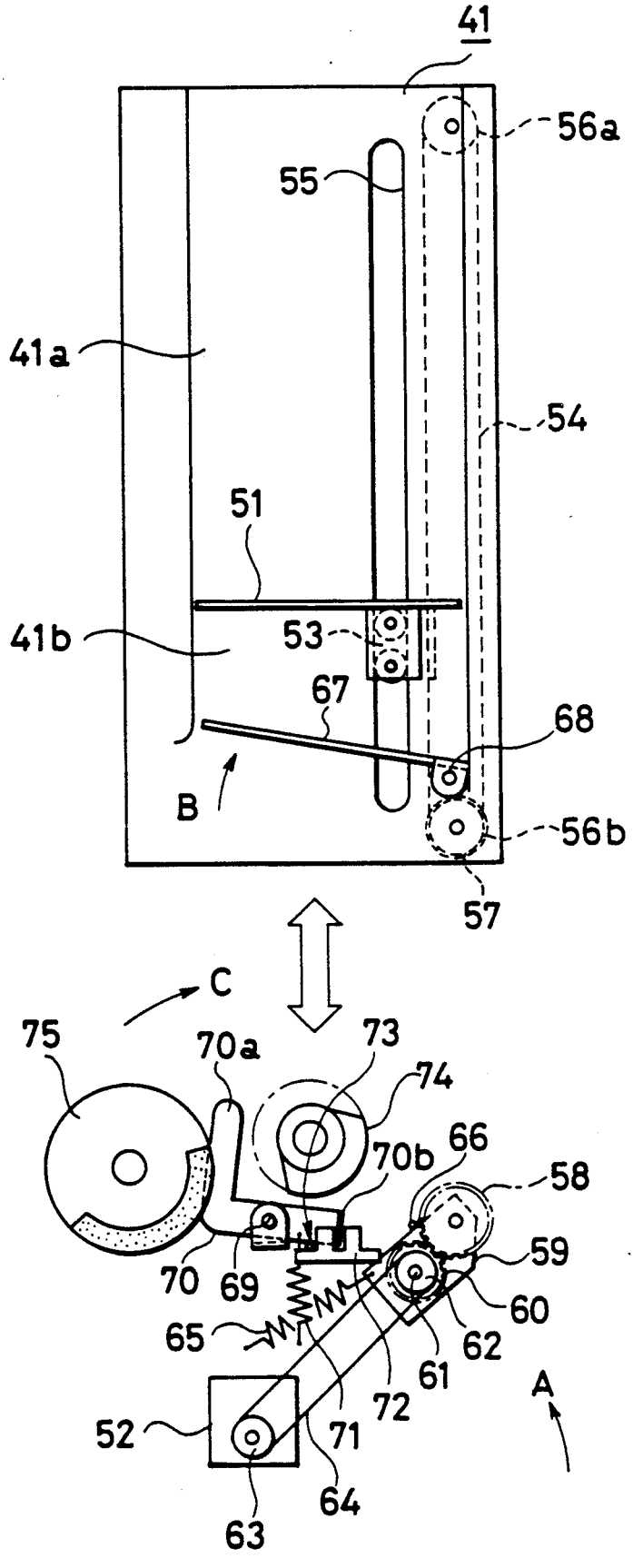
FIG. 2 is a schematic drawing showing the structure of a third stacker and a portion where the third stacker is mounted.

FIG. 2 is a schematic drawing showing the structure of the third stacker 41 and a portion of the bill receiving and dispensing machine 1 where the third stacker 41 is to be mounted.

Referring to FIG. 2, the third stacker 41 is detachable from the bill receiving and dispensing machine 1 and the bill holding plate 51 for dividing the third stacker 41 into the received bill storing compartment 41*a* and the dispensation bill storing compartment 41*b* are movable in the vertical direction while being held horizontally in the third stacker 41 by an elevator motor 52. A guide member 53 is secured to one edge of the lower face of the bill holding plate 51, connected to an endless belt 54 and guided by a guide groove 55 extending in the vertical direction.

The endless belt 54 is engaged with an upper pulley 56*a* provided at a upper portion of the third stacker 41 and a lower pulley 56*b* provided at a lower portion of the third stacker 41 and the lower pulley 56*b* is formed with a gear 57 the center shaft of which is that of the lower pulley 56*b* and which engages with a gear 58 provided for the body of the bill receiving and dispensing machine 1 when the third stacker 41 is mounted on the bill receiving and dispensing machine 1.

The gear 58 provided for the body of the bill receiving and dispensing machine 1 is supported by a third stacker mount member 59 and engaged with a drive gear 60. A rotation shaft 61 of the drive gear 60 is formed with a pulley 62 and an endless belt 64 is engaged with the pulley 62 and a pulley 63 formed on a center shaft of the elevator motor 52.

Accordingly, when the elevator motor 53 is driven, the driving force is transmitted to the bill holding plate 51 via the pulley 63, the belt 64, the pulley 62, the drive gear 60, the gear 58, the gear 57, the lower pull 56*b*, the belt 54 and the guide member 53 and the bill holding plate 51 is moved while being guided by the guide groove 55 in the vertical direction by the elevator motor 52.

The third stacker mount member 59 is mounted on the bill receiving and dispensing machine 1 so as to be swingable about the rotation shaft 61 and is normally biased in the direction indicated by an arrow A in FIG. 2 by a tension spring 65 secured thereto at one end, the other end of the tension spring being secured to the bill receiving and dispensing machine 1. Accordingly, in the condition where the third stacker 41 is mounted on the bill receiving and dispensing machine 1, the gears 57 and 58 are engaged with each other by engaging force of a predetermined magnitude. Further, a projection 66 is provided so that the third stacker mount member 59 can be positioned at a predetermined position even if it is biased by the tension spring 65 in the condition where the third stacker 41 is not mounted on the bill receiving and dispensing machine 1.

In the thus constituted third stacker 41, when the teller inputs bill receiving instructions to the bill receiving and dispensing machine 1 after the received bills have been received in the first, second and third pool sections 18, 20 and 22, the elevator motor 52 is driven and the bill holding plate 51 is moved upwardly to the position close to the third pool gate 36 in the third stacker 41. At the same time, the pool gate motor 33 is driven and the third pool gate 36 is opened, whereby the bills temporarily stored in the third pool section 22 are received by the bill holding plate 51 and accumulated thereon.

At the lower end portion of the third stacker 41, that is, at the lower end portion of the dispensation bill storing compartment 41*b*, there is provided a bottom plate 67 for holding the bills having the third denomination for dispensation thereon. The bottom plate 67 is swingably mounted on a horizontal shaft 68 and biased in the direction indicated by an arrow B in FIG. 2 by a torsion spring (not shown) provided between the bottom plate 67 and the horizontal shaft 68.

An L-shaped detecting lever 70 is mounted on the bill receiving and dispensing machine 1 so as to be swingable about a horizontal shaft 69. An upper end 70*a* directed upwardly of the detecting lever 70 is abuttable against the lower face of the bottom plate 67 and a tension spring 71 is secured to the detecting lever 70 in the vicinity of the other end, that is, a lower end 70*b* thereof, whereby the detecting lever 70 is biased in the direction indicated by an arrow C in FIG. 2. A limit sensor 72 is provided in the vicinity of the lower end 70*b* of the detecting lever 70 and turned on in the condition where the bottom plate 67 abuttable against the upper end 70*a* of the detecting lever 70 is horizontal, while it is turned off in the other condition.

Further, a projection 73 is provided for the bill receiving and dispensing machine 1 so that the detecting lever 70 is positioned at a predetermined position even if it is biased by the tension spring 71 in the condition where the upper end 70*a* of the detecting lever 70 does not abut against the bottom plate 67.

As shown in FIG. 2, a feed roller 74 and a take-out roller 75 are provided in the vicinity of the L-shaped detecting lever 70 for dispensing the bills stored in advance in the dispensation bill storing compartment 41*b* of the third stacker 41. More specifically, the bottom plate 67 has the same shape as those of the bill holding plates 9, 39*b* and 40*b* and when dispensing the bills, the feed roller 74 and the take-out roller 75 respectively project upwardly from the upper face of the bottom plate 67 via an opening (not shown) formed in the bottom plate 67 and a notch (not shown) formed at a portion of the bottom plate 67 on the side of a bill take-out opening (not shown). Further, although not shown, at the bill take-out opening through which the bills are taken out for dispensation from the dispensation bill storing compartment 41*b* of the third stacker 41, there is provided a shutter for opening and closing the bill take-out opening driven by a shutter solenoid 76.

Figure 3:
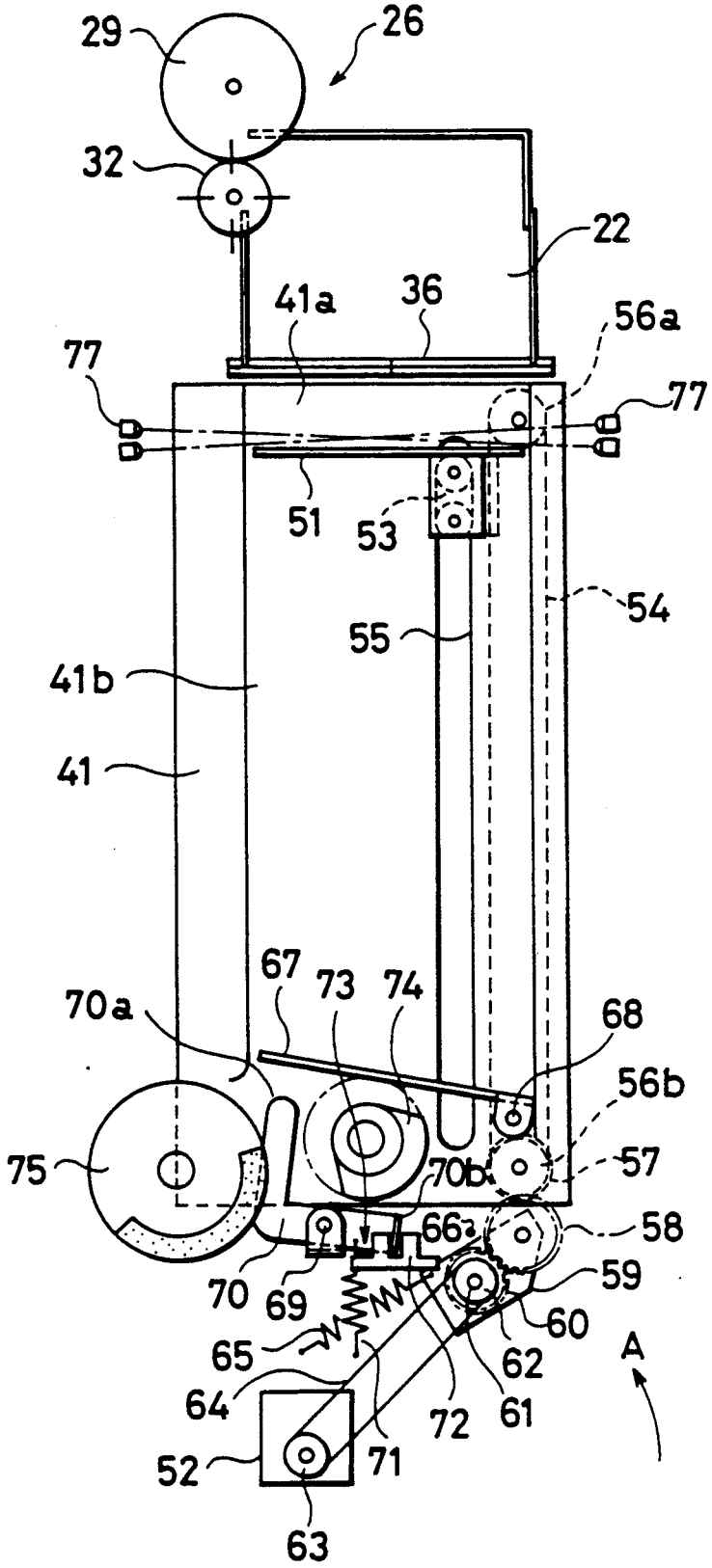
FIGS. 3 and 4 are schematic drawings showing the structure of the third stacker and the portion where the third stacker is mounted in the condition where the third stacker is mounted on the bill receiving and dispensing machine, FIG. 3 showing the operational state when the received bills stored in a third pool section are being received into a received bill storing compartment and FIG. 4 showing the operational state when the bills stored in a dispensation bill storing compartment are being fed out.
Figure 4:
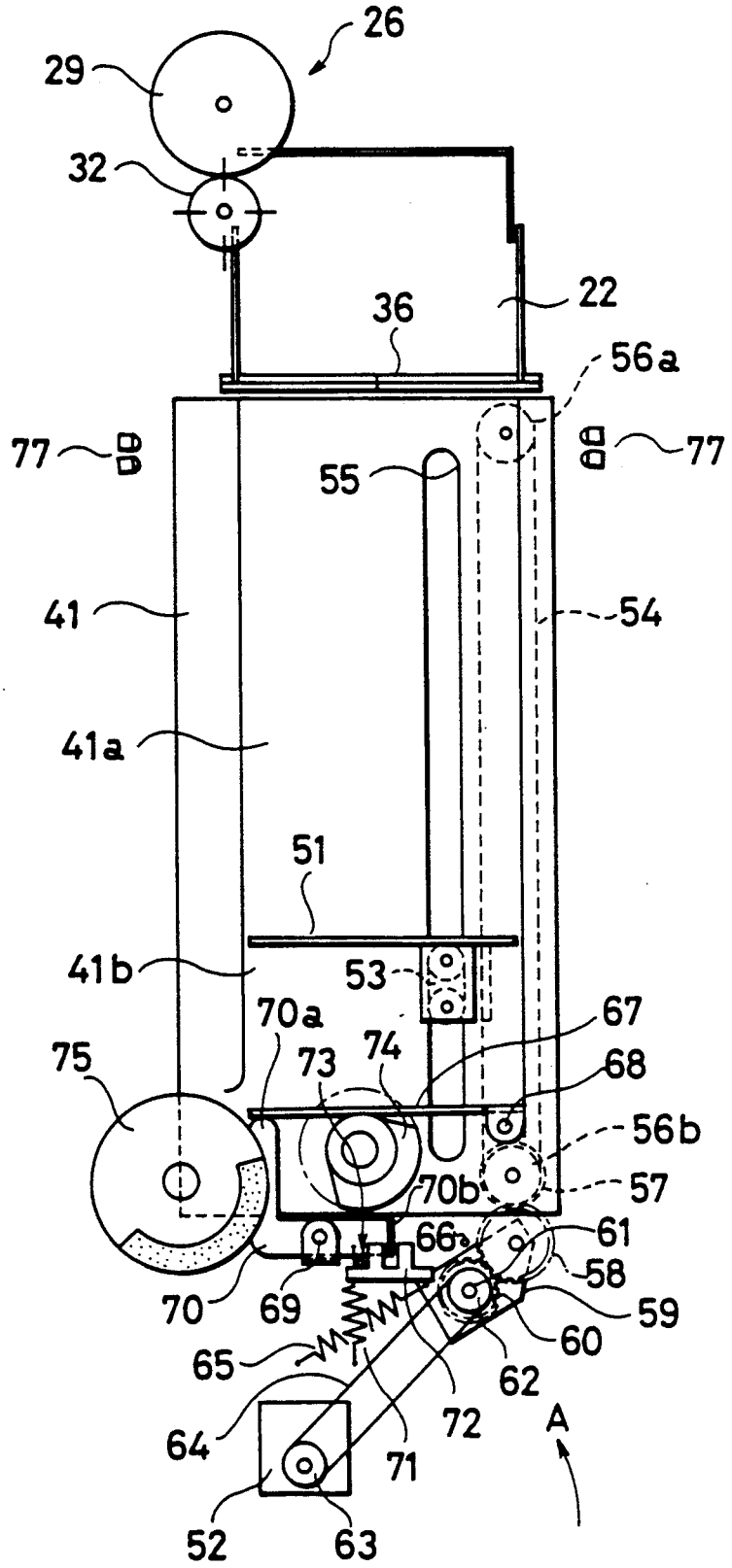

FIGS. 3 and 4 are schematic drawings showing the structure of the third stacker 41 and the portion where the third stacker 41 is mounted in the condition where the third stacker 41 is mounted on the bill receiving and dispensing machine 1. FIG. 3 shows the operational state thereof when the received bills temporarily stored in the third pool section 22 are being received into the received bill storing compartment 41*a* and FIG. 4 shows the operational state thereof when the bills stored in the dispensation bill storing compartment 41*b* are being taken out.

Referring to FIG. 3, the bill holding plate 51 is positioned at the upper position close to the third pool gate 36 for receiving the bills from the third pool section 22 and whether or not the bill holding plate 51 is positioned at the upper position is detected by a limit sensor 77. In this condition, the bottom plate 67 is biased by the torsion spring (not shown) in the direction indicated by an arrow B in FIG. 3 and swung about the horizontal shaft 68 so as to be inclined with respect to the horizontal plane.

Then, when the pool gate motor 33 is driven, the third pool gate 36 is opened, whereby the bills temporarily stored in the third pool section 22 are received by the bill holding plate 51 and accumulated thereon.

Afterward, the elevator motor 52 is driven and the driving force is transmitted to the bill holding plate 51 via the pulley 63, the belt 64, the pulley 62, the drive gear 60, the gear 58, the gear 57, the lower pulley 56*b*, the belt 54 and the guide member 53, whereby the bill holding plate 51 is moved downwardly to the lowermost position and then the third pool gate 36 is closed.

Although not shown, since the bills having the third denomination for dispensation are stored in advance as held on the upper face of the bottom plate 67 in the dispensation bill storing compartment 41*b* of the third stacker 41, as the result of lowering the bill holding plate 51, the bill holding plate 51 presses the bills held on the bottom plate 67, thereby to push away the bottom plate 67 against the biasing force of the torsion spring in the direction opposite to that indicated by the arrow B. As a result, the lower face of the bottom plate 67 abuts against the upper end 70*a* of the L-shaped detecting lever 70, whereby the detecting lever 70 is swung about the horizontal shaft 69 against the biasing force of the tension spring 71 in the direction opposite to that indicated by the arrow C. Thus, when the bottom plate 67 has become horizontal, the limit sensor 72 provided in the vicinity of the lower end 70*b* of the L-shaped detecting lever 70 is turned on and it is detected that the bottom plate 67 becomes horizontal. In this condition, the bills to be dispensed and held on the upper face of the bottom plate 67 are pressed by the lower face of the bill holding plate 51, while the feed roller 74 and the take-out roller 75 respectively project upwardly from the upper face of the bottom plate 67 via the opening (not shown) formed in the bottom plate 67 and the notch (not shown) formed in the bottom plate in the vicinity of the bill take-out opening. Accordingly, frictional force of a predetermined magnitude is produced between the lower face of the lowermost bill, and the feed roller 74 and the takeout roller 75, whereby the bills having the third denomination can be taken out one by one from the dispensation bill storing compartment 41*b* by rotating the feed roller 74 and the take-out roller 75.

The bills taken out by the feed rollers 44, 45, 74 and the take-out rollers 46, 47, 75 from the thus constituted bill storing compartment 39*a* of the first stacker 39, the bill storing compartment 40*a* of the second stacker 40 and the dispensation bill storing compartment 41*b* of the third stacker 41 are fed to a dispensed bill discriminating section 80 by bill transporting belts 79 driven by a bill dispensing motor 78. The dispensed bill discriminating section 80 discriminates denominations of the bills, double feed and other transporting errors, for example, whether or not the bills are being transported obliquely with respect to the longitudinal direction of the bills and whether or not the interval between successive bills is greater than a predetermined one, and the value of the dispensed bills.

The bills discriminated by the dispensed bill discriminating section 80 are fed to a gate 81. When the dispensed bill discriminating section 80 has judged that the bills of different denominations from a predetermined one are fed or has detected double feed or other transporting errors, the gate 81 is switched by a solenoid (not shown) and the bills are fed to a dispensed bill reject section 82 where they are stored. Otherwise, the bills are further fed to the bill dispensation opening 3 via the gate 81.

In the vicinity of the bill dispensation opening 3, there is provided a bill dispensing mechanism 83 comprising a shutter 84 for opening and closing the bill dispensation opening 3 and a shutter motor 85 for driving the shutter 84. Accordingly, when all the bills have been fed to the bill dispensation opening 3 in accordance with the teller's instruction, the shutter motor 85 is driven to enable the shutter 84 to open the bill dispensation opening 3 and the bills to be dispensed are taken out via the bill dispensation opening 3 by the teller.

Although not shown, the bill receiving and dispensing machine has a cover divided into two sections and the internal mechanism of the machine can be exposed by moving the two sections of the cover apart from each other. Therefore, in cases where the customer request that the bill dispensation be stopped or the teller notices that the value of the dispensed bills was erroneously set after the dispensed bills have been fed to the bill dispensation opening 3, the teller can take the dispensed bills out, expose the internal mechanism of the bill receiving and dispensing machine 1 by separating the two sections of the cover and store the taken-out bills in a rejected bill storing section 86.

As explained above, in this embodiment, the third stacker 41 is detachable from the bill receiving and dispensing machine 1 and the bills of the first or second denomination for dispensing are fed to and stored in the first stacker 39 or the second stacker 40 via the third stacker 41 prior to starting the bill receiving and dispensing operation.

More specifically, prior to the bill receiving and dispensing operation, the bills of the first denomination, such as 10000 yen, to be dispensed from the first stacker 39 and/or the second denomination, such as 1000 yen, to be dispensed from the second stacker 40, which are frequently used, are put into the dispensation bill storing compartment 41*b* of the third stacker 41 detached from the bill receiving and dispensing machine 1 and the third stacker 41 is attached to the machine 1. Afterward, the bill holding plate 51 is moved downwardly by the elevator motor 52 until the limit sensor 72 detects that the bottom plate 67 has become horizontal and then, the feed roller 74 and the take-out roller 75 are rotated. As a result, the bills are fed to the dispensation bill passage 5 and further fed to a gate 87 via the dispensed bill discriminating section 80. The gate 87 has been switched by a solenoid (not shown) so that the bills can be fed to a connection passage 88 connecting the dispensation bill passage 5 to a portion of the bill receiving passage 4 upstream of the received bill discriminating section 16, and, therefore, the bills are fed via the connection passage 88 and the bill receiving passage 4 to the received bill discriminating section 16 where their denominations, genuineness, condition and double feed etc. are discriminated and the value of the bills are counted. Then, the bills are fed to the first pool section 18 or the second pool section 20 by the first pool gate 17 or the second pool gate 19 and are further received in the bill storing compartment 39*a* of the first stacker 39 or the bill storing compartment 40*a* of the second stacker 40 where they are stored in the same manner as the received bills. Thus, after the feeding operation of the bills for dispensing to be stored in the bill storing compartment 39*a* of the first stacker 39 or the bill storing compartment 40*a* of the second stacker 40 has been completed, the third stacker 41 is detached from the bill receiving and dispensing machine 1. Then, the bills of the third denomination, such as 5000 yen, which are not used so frequently as the first and second denominations and the third stacker 41 is attached to the bill receiving and dispensing machine 1.

Further, after the bill receiving and dispensing operation has been completed, the bills remaining in the bill storing compartment 39*a* of the first stacker 39 and/or the bill storing compartment 40*a* of the second stacker 40 are collected in a similar manner to that described above. More specifically, the gate 87 is switched in advance by the solenoid (not shown) so that the bills being transported in the bill dispensation passage 5 are fed to the connection passage 88 connecting the dispensation bill passage 5 and the portion of the bill receiving passage 4 upstream of the received bill discriminating section 16 and the first gate 17 and the second gate 19 are switched by the solenoids (not shown) so that the bills being transported in the bill receiving passage 4 are passed through the first and second gates 17, 19 and fed to the third gate 21, while the third gate 21 is switched so that all the bills are fed to the third pool section 22. Afterward, the bills are taken out from the bill storing compartment 39*a* of the first stacker 39 and/or the bill storing compartment 40*a* of the second stacker 40 and fed to the third pool section 22 via the gate 87, the connection passage 88, the bill receiving passage 4, the received bill discriminating section 16, the first gate 17, the second gate 19 and the third gate 21. Further, the third pool gate 36 is opened to enable the received bill storing compartment 41*a* of the third stacker 41 to receive the bills. Then, the third stacker 41 is detached from the bill receiving and dispensing machine 1 and the bill stored therein are collected.

Figure 5:
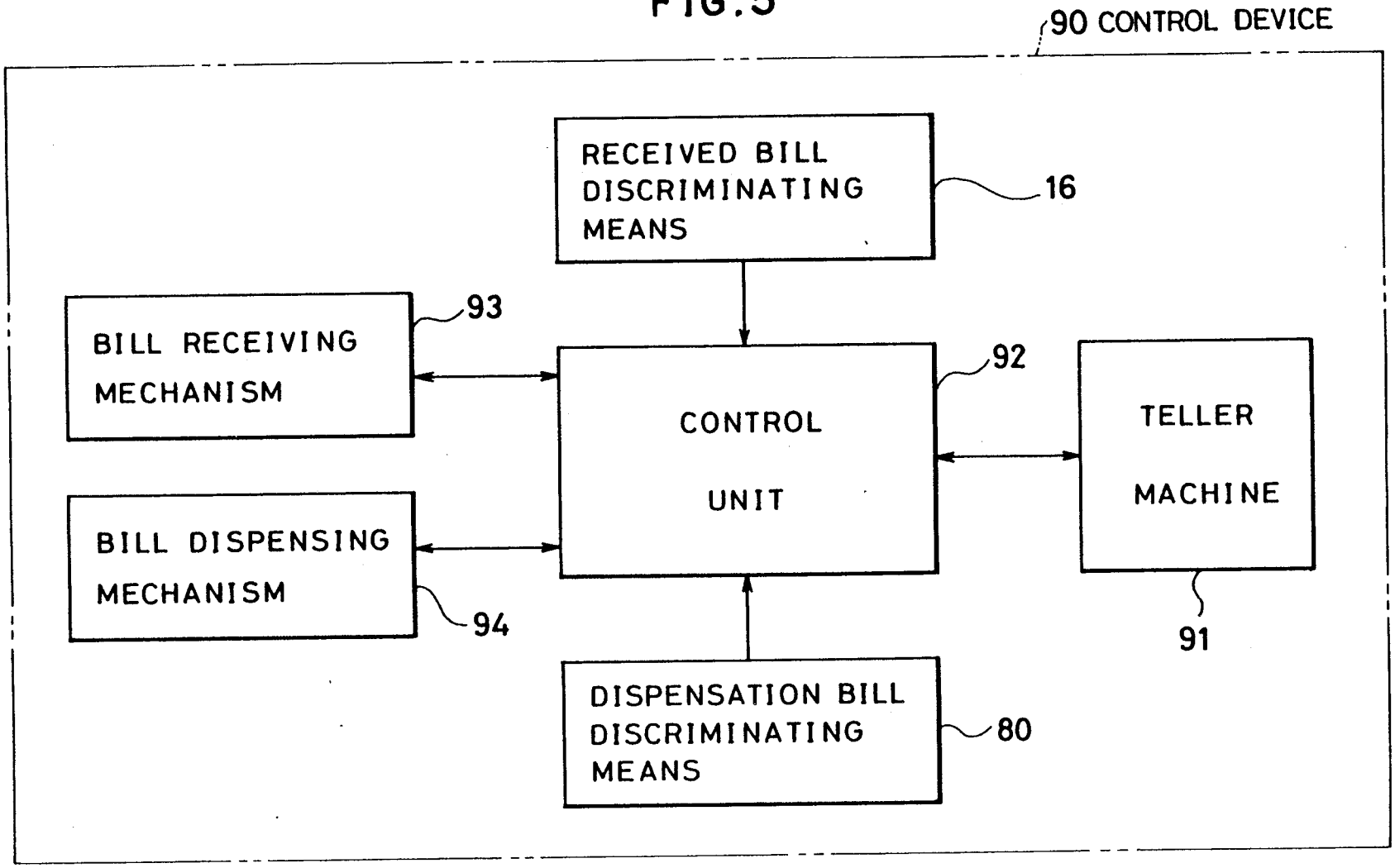
FIG. 5 is a block diagram showing a control device of the bill receiving and dispensing machine shown in FIG. 1.

FIG. 5 is a block diagram showing a control device 90 of the bill receiving and dispensing machine 1 which is an embodiment of the present invention.

Referring to FIG. 5, the reference numeral 91 designates a teller machine to which the teller inputs bill receiving instructions and bill dispensing instructions, instruction signals are input to a control unit 92 which outputs instruction signals to a bill receiving mechanism 93 and a bill dispensing mechanism 94 in order to enable them to conduct appropriate operations. Further, bill receiving signals and bill dispensing signals are respectively input from the received bill discriminating section 16 and the dispensed bill discriminating section 80 to the control unit 92.

In the thus constituted control device 90, prior to starting the bill receiving and dispensing operation, when the bills to be dispensed are stored in the first stacker 39, the second stacker 40 and the third stacker 41 of the bill receiving and dispensing machine, the teller detaches the third stacker 41 from the bill receiving and dispensing machine 1 and puts the bills of the first denomination to be stored in the bill storing compartment 39*a* of the first stacker 39 and the bills of the second denomination to be stored in the bill storing compartment 40*a* of the second stacker 40 into the dispensation bill storing compartment 41*b* of the third stacker 41. After the teller has attached the third stacker 41 to the bill receiving and dispensing machine 1, the teller inputs a bill storing instruction to the teller machine 91. When the bill storing instruction is input to the teller machine 91, the teller machine 91 outputs a bill storing instruction signal to the control unit 92 and the control unit 92 drives the elevator motor 52 of the bill dispensing mechanism 94, thereby to move the bill holding plate 51 downwardly. When the bill holding plate 51 is moved downwardly while pressing the bills held on the bottom plate 67 and the limit sensor 72 detects that the bottom plate 67 has become horizontal, a bill press completion signal is output from the limit sensor 72 to the control unit 92 and then the control unit 92 outputs a bill take-out signal to the bill dispensing motor 78 of the bill dispensing mechanism 94. In accordance with the bill takeout signal, the feed roller 74 and the take-out roller 75 are rotated and the bills of the first or second denomination stored in the dispensation bill storing compartment 41*b* of the third stacker 41 are taken out one by one by frictional force produced between the lower face of the lowermost bill, and the feed roller 74 and the take-out roller 75. At the same time that the control unit 92 outputs the bill take-out signal, the control unit 92 outputs a gate switching signal to the solenoid (not shown) to switch the gate 87 to the side of the connection passage 88. As a result, the bills taken out one by one from the dispensation bill storing compartment 41*b* of the third stacker 41 are fed to the bill receiving passage 4 via the dispensation bill passage 5, the gate 87 and the connection passage 88, and their denominations, genuineness, condition and double feed etc. are discriminated and the value of the bills is counted by the received bill discriminating section 16. Then, the bills are fed into the first pool section 18 or the second pool section 20 by the first gate 17 or the second gate 19 and further received in the bill storing compartment 39*a* of the first stacker 39 or the bill storing compartment 40*a* of the second stacker 40. The value of the bills counted by the received bill discriminating section 16 is output as a received bill count signal to the control unit 92 and stored in a memory (not shown) in the control unit 92. Thus, after the feeding operation of the bills for dispensing to be stored in the bill storing compartment 39*a* of the first stacker 39 or the bill storing compartment 40a of the second stacker 40 has been completed, the third stacker 41 is detached from the bill receiving and dispensing machine 1. Then, the bills of the third denomination, such as 5000 yen, which are not used so frequently as the first and second denominations are stored in the dispensation bill storing compartment 41a and the third stacker 41 is attached to the bill receiving and dispensing machine 1. The value of the bills of the third denomination stored in the dispensation bill storing compartment 41b of the third stacker 41 is input manually by the teller and is further input to the control unit 92 as the received bill count signal to be stored in the memory (not shown) in the control unit 92.

Thus, after the bills of each denomination have been put into the bill receiving and dispensing machine 1, the bill receiving and dispensing operation is started.

In the case of receiving the bills, the teller deposits the bills into the bill receiving and dispensing machine 1 via the bill depositing opening 2 and inputs a bill receiving instruction to the teller machine 91. In accordance with the bill receiving instruction, the teller machine 91 outputs a bill receiving instruction signal to the control unit 92, whereby the control unit 92 drives the bill receiving motor 6 of the bill receiving mechanism 93 and rotates the feed roller 15 and the take-out roller 14 to arrange the lower edges of the received bills uniformly. Afterward, the bill press motor 12 of the bill receiving mechanism 93 is driven and the bill press member 13 is moved downwardly to press the received bills held on the bill holding plate 9. Then, the bill take-out opening is opened by driving the shutter solenoid 11 and moving the shutter (not shown) of the bill receiving means 8 and the feed roller 15 and the take-out roller 14 are rotated by driving the bill receiving motor 6, whereby the bills held on the bill holding plate 9 are taken out one by one to the bill transporting belts 7 via the bill take-out opening. The thus taken-out bills are transported along the bill receiving passage 4 and their denominations, genuineness, condition and double feed etc. are discriminated and the their value is counted by the received bill discriminating section 16. The results of discrimination and counting conducted by the received bill discriminating section 16 are input to the control unit 92 and are respectively stored in memories (not shown) in the control unit 92. In accordance with the results of discrimination and counting conducted by the received bill discriminating section 16, the control unit 92 drives the solenoid (not shown) and switches the first gate 17, the second gate 19 and the third gate 21 for each of the received bills so that the genuine and undamaged bills of the first denomination are fed into the first pool section 18, that the genuine and undamaged bills of the second denomination are fed into the second pool section 20, that the genuine bills of the third denomination, and the genuine but damaged bills of the first or second denomination are fed into the third pool section 22 and that the counterfeit bills and the doubly fed bills are fed into the bill return opening 23.

Further, as the result of counting the value of the bills of the first or second denomination conducted by the received bill discriminating section 16, when the received bill discriminating section 16 judges that the first pool section 18 or the second pool section 20 cannot receive the bills any longer, the control unit 92 switches the first gate 17 or the second gate 19 so that the genuine bills of the first o second denomination can be received in the third pool section 22.

When the control unit 92 judges that the feeding operation of all of the received bills into the first pool section 18, the second pool section 20, the third pool section 22 and the bill return opening 23 has been completed, the control unit 92 displays the value of the received bills stored in the memory thereof on the teller machine 91.

The teller confirms the genuineness of the bills returned to the bill return opening 23 and, as a result, when the teller discriminates that some of them are genuine, the teller again deposits the bills discriminated as genuine into the bill receiving and dispensing machine 1 and repeats such operation until the value of the received bills displayed on the teller machine 91 agrees with that expected by the teller.

As a result, when the value of the bills counted by the received bill discriminating section 16 and displayed on the teller machine 91 agrees with that expected by the teller and the teller judges that there is no trouble in permitting the bill receiving and dispensing machine 1 to receive the bills, the teller inputs a bill receiving confirmation instruction to the teller machine 91 to input a bill receiving confirmation instruction signal to the control unit 92. In accordance with the bill receiving confirmation instruction signal, the control unit 92 drives the elevator motors 42, 43, 52 to move the bill holding plate 39b of the first stacker 39, the bill holding plate 40b of the second stacker 40 and the bill holding plate 51 of the third stacker 41 respectively. In the condition that the bill holding plates 39b, 40b, 51 are positioned at their upper positions close to the first, second and third pool gates 34, 35 and 36, the first, second and third pool gates 34, 35 and 36 are opened and the bills are delivered from the first, second and third pool sections 18, 20 and 22 onto the bill holding plate 39b of the first stacker 39, the bill holding plate 40b of the second stacker 40 and the bill holding plate 51 of the third stacker 41. Then, the elevator motors 42, 43 and 52 are driven again and the bill holding plates 39b, 40b and 51 holding the received bills thereon are moved downwardly.

On the contrary, when some of the bills discriminated by the teller as genuine have not been accepted by the bill receiving and dispensing machine, the teller stores them separately and inputs the value thereof as the value of the received bills to the teller machine 91. The thus input value of the bills is stored in a memory different from that storing the value of the received bills counted by the bill receiving and dispensing machine 1.

Further, in cases where the customer requests that the bill receiving operation be stopped, for example, in the case where some of the bills returned to the bill return opening 23 are counterfeit and the teller judges that they are unacceptable, the teller inputs a bill return instruction to the teller machine 91 to input a bill return instruction signal to the control unit 92. Then, the control unit 92 turns the pool section lock solenoid 38 off and the teller pulls out the first, second and third pool sections 18, 20 and 22 from the machine 1 and collects the bills stored therein to return them to the customer together with the bills returned to the bill return opening 23.

In the case of dispensing bills, the teller inputs a bill dispensing instruction to the teller machine 91 to input a bill dispensing instruction signal to the control unit 92. Then, the control unit 92 reads out the number of the bills of each denomination stored in the memory (not shown) in the control unit 92, that is, the number of the bills stored in each of the first, second and third stackers 39, 40 and 41. In the memory in the control unit 92, the value of the bills put in prior to starting the bill receiving and dispensing operation and received in each of the first, second and third stackers 39, 40 and 41 is input by addition based upon the counted value of the received bill discriminating section 16, and when some of the bills have been dispensed, the value of the dispensed bills of each denomination counted by the dispensed bill discriminating section 80 is deducted. Thus, the memory always stores the value of the bills of each denomination stored in the first, second and third stackers 39, 40 and 41, that is, the number of the bills of each denomination at any given time. The control unit 92 compare the number of the bills of the first denomination and the bills of the second denomination among the thus read out number of the bills of each denomination with predetermined numbers for the first and second denominations stored in advance. As a result, when the control unit 92 judges that at least one of the read-out number of bills of the first and second denominations is not greater than the predetermined number, it outputs a drive signal to the bill dispensing mechanism for driving the bill press member drive motor 48*a* and/or 48*b* of the stacker 39 and/or 40 storing the bills of that denomination and swings the swing member 39*d* and/or 40*d* clockwise in FIG. 1 so that the bill press member 39*f* and/or 40*f* presses the bills held on the bill holding plate 39*b* and/or 40*b* of the stacker 39 and/or 40 to produce frictional force of the predetermined magnitude between the lower face of the lowermost bill, and the feed roller 44 and/or 45 and the take-out roller 46 and/or 47. At the same time, the control unit 92 drives the elevator motor 52 and moves the bill holding plate 51 of the third stacker 41 downwardly until the limit sensor 72 detects that the bottom plate 67 has become horizontal so that the bill holding plate 51 presses the bills held on the bottom plate 67 to produce frictional force of the predetermined magnitude between the lower face of the lowermost bill, and the feed roller 74 and the take-out roller 75.

When the control unit 92 judges that the pressing operation of the bill press member 39*f* and/or 40*f* and the holding plate 51 has been completed, the control unit 92 drives the bill dispensing motor 78 and rotates the feed rollers 44, 45 and 74 and the take-out rollers 46, 47 and 75, thereby to feed out the bills one by one to the dispensation bill passage 5. The dispensed bill discriminating section 80 discriminates the denominations, genuineness, condition and double feed of the thus fed out bills, counts the value thereof and outputs the counted value of the bills to the memory of the control unit 92 so that it is deducted from the value of the bills stored in the memory.

In accordance with the results of discrimination conducted by the dispensed bill discriminating section 80, the control unit 92 drives the solenoid (not shown) and feeds the bills by the gate 81 into the dispensed bill reject section 82 where they are stored, when it judges that the bills of a different denomination from that to be dispensed have been dispensed, that double feed has occurred or that other bill transporting error has occurred. The other bills are fed to the bill dispensation opening 3. When the control unit 92 judges that all of the dispensed bills have been fed to the bill dispensation opening 3, this is displayed on the teller machine 91. Then, when the teller inputs a bill takeout instruction to the teller machine 91, the control unit 92 outputs a bill take-out instruction signal to the bill dispensing mechanism 94 t drive the shutter motor 85 and the shutter opens the bill dispensation opening 3 so that the teller can take out the dispensed bills.

In the case where the bills remaining in the first stacker 39 and the second stacker 40 are to be collected after the bill receiving and dispensing operation has been completed, the teller inputs a bill collect instruction to the teller machine 91 and a bill collect instruction signal is output to the control unit 92. When the control unit 92 receives the bill collect instruction signal, it drives the solenoid (not shown) to switch the gate 87 so that the bills transported along the dispensation bill passage 5 are fed to the connection passage 88 connecting the dispensation bill passage to the portion of the bill receiving passage 4 upstream of the received bill discriminating section 16, and also drives the solenoids (not shown) to switch the first gate 17 and the second gate 19 so that the bills transported along the bill receiving passage 4 are passed through the first and second gates 17 and 19 and fed to the third gate 21 and to switch the third gate 21 so that all of the bills are fed to the third pool section 22. Afterward, the bills are taken out from the bill storing compartment 39*a* of the first stacker 39 and the bill storing compartment 40*a* of the second stacker 40 and are fed to the third pool section 22 via the gate 87, the connection passage 88, the bill receiving passage 4, the received bill discriminating section 16, the first gate 17, the second gate 19 and the third gate 21. After all of the bills have been fed into the third pool section 22, the third pool gate 36 is opened and the bills are received in the received bill storing compartment 41*a* of the third stacker 41. When all of the bills have been received in the received bill storing compartment 41*a*, this is displayed on the teller machine 91. Then, the teller detaches the third stacker 41 from the bill receiving and dispensing machine 1 and collects the bills stored in the received bill storing compartment 41*a*.

According to the above described embodiment, the third stacker 41 for the bills of the third denomination which are not used so frequently is divided into the upper compartment and the lower compartment by the bill holding plate 51, and the received bills of the third denomination are not used for dispensation and are stored in the received bill storing compartment formed above the bill holding plate 51 together with the bills which could not be received by the first pool section 18 and the second pool section 20 and the damaged bills. The bills of the third denomination for dispensing are stored in advance in the dispensation bill storing compartment 41*b* formed below the bill holding plate 51 and when dispensing the bills of the third denomination, the bills stored in the dispensation bill storing compartment 41*b* are pressed by the bill holding plate 51 for holding the received bills thereon and dividing the third stacker 41 into two upper and lower compartments so that frictional force of the predetermined magnitude can be produced between the lower face of the lowermost bill, and the feed roller 74 and the take-out roller 75 and the bills are dispensed. Therefore, since it is possible to reduce the space required for storing the received bills of the third denomination which are not used so frequently as compared with that for storing the bills of the first or second denomination which are frequently used and it is unnecessary to provide a bill press member for pressing the bills of the third denomination to be dispensed separately, the bill receiving and dispensing machine 1 can be made compact.

As described in detail with reference to the preferred embodiment, according to the present invention, it is possible to make the bill receiving and dispensing machine small in size.

The present invention has thus been shown and described with reference to the specific embodiment. However, it should be noted that the present invention is in no way limited to the details of the described arrangements but changes and modifications may be made without departing from the scope of the appended claims.

For example, in the above described embodiment, although only the third stacker 41 is detachable from the bill receiving and dispensing machine 1, the second and third stacker 39, 40 may be constituted to be detachable from the machine 1. In the thus constituted machine, prior to starting the bill receiving and dispensing operation, the bills to be dispensed can be stored by detaching the first, second and third stackers 39, 40 and 41 and putting the bills thereinto, and after the bill receiving and dispensing operation has been completed, the bills remaining in the stackers 39, 40 and 41 can be collected by detaching them from the machine 1. However, in the thus constituted machine, since the value of the bills of the first or second denomination is not counted by the received bill discriminating section 16 when putting them into the machine the teller inputs the value of the bills put into the machine prior to starting the bill receiving and dispensing operation to the teller machine 91 manually.

Further, in the above described embodiment, although the feed rollers 15, 44, 45, 74 and the take-out rollers 14, 46, 47, 75 are employed for dispensing the bills of each denomination, it is possible to dispense bills of specific denominations or all denominations by use of the take-out rollers.

Furthermore, in the above described embodiment, although when dispensing the bills of the third denomination, whether the bill holding plate 51 presses the bills to an extent that the dispensing operation can be started and the dispensing operation is ready is detected by the detecting lever 70 and the limit sensor 72 depending upon whether or not the swingable bottom plate 67 has become horizontal, such detection can be carried out by fixing the bottom plate 67 horizontal and detecting the position of the bill holding plate 51.

I claim:

1. A bill receiving and dispensing machine capable of receiving bills of a plurality of denominations and dispensing bills of at least one denomination among the denominations of the received bills and comprising a plurality of stacker means for storing the received bills and feed-out roller means for taking out bills stored in said plurality of stacker means one by one from said plurality of stacker means by frictional force between the feed-out roller means and the lower face of the lowermost bills, said feed-out roller means being positioned at a lower portion of said plurality of stacker means, one of said plurality of stacker means comprising pool means for temporarily storing the received bills of a denomination of less frequent use compared to the other denominations of the received bills and the received bills which cannot be received in other stacker means, bill holding plate means for receiving bills from said pool means and holding them on the upper face thereof, said bill holding plate means being movable in the vertical direction while being held horizontally, and bottom plate means for holding bills of the denomination of less frequent use compared to the other denominations of the received bills and are exclusively used to be dispensed on the upper face thereof, said bottom plate means being disposed at a bottom portion of said one of the plurality of stacker means, said bill receiving and dispensing machine further including elevating means for moving and positioning said bill holding plate means at an upper position close to said pool means when receiving the received bills from said pool mean and moving and positioning said bill holding plate means at a lower position where said bill holding plate means can press the bills held on said bottom plate means when feeding out the bills held on said bottom plate means from said one of the plurality of stacker means.

2. A bill receiving and dispensing machine in accordance with claim 1 wherein said feed-out roller means comprising at least one feed roller and at least one take-out roller which are abuttable against the lower face of the lowermost bill stored in said stacker means.

3. A bill receiving and dispensing machine in accordance with claim 1 wherein said one of the plurality of stacker means is detachable from said bill receiving and dispensing machine.

4. A bill receiving and dispensing machine in accordance with claim 2 wherein said one of the plurality of stacker means is detachable from said bill receiving and dispensing machine.

5. A bill receiving and dispensing machine in accordance with claim 1 wherein said plurality of stacker means is detachable from said bill receiving and dispensing machine.

6. A bill receiving and dispensing machine in accordance with claim 2 wherein said plurality of stacker means is detachable from said bill receiving and dispensing machine.

7. A bill receiving and dispensing machine in accordance with claim 3 wherein said bottom plate means is mounted on said one of the plurality of stacker means swingably about a horizontal shaft and which further includes sensor means for judging that said bill holding plate means has been moved to said lower position by detecting that said bottom plate means has become horizontal.

8. A bill receiving and dispensing machine in accordance with claim 4 wherein said bottom plate means is mounted on said one of the plurality of stacker means swingably about a horizontal shaft and which further includes sensor means for judging that said bill holding plate means has been moved to said lower position by detecting that said bottom plate means has become horizontal.

9. A bill receiving and dispensing machine in accordance with claim 5 wherein said bottom plate means is mounted on said one of the plurality of stacker means swingably about a horizontal shaft and which further includes sensor means for judging that said bill holding plate means has been moved to said lower position by detecting that said bottom plate means has become horizontal.

10. A bill receiving and dispensing machine in accordance with claim 6 wherein said bottom plate means is mounted on said one of the plurality of stacker means swingably about a horizontal shaft and which further includes sensor means for judging that said bill holding plate means has been moved to said lower position by detecting that said bottom plate means has become horizontal.

* * * * *